US005087213A

United States Patent [19]

Drapcho et al.

[11] Patent Number: 5,087,213

[45] Date of Patent: Feb. 11, 1992

[54] LAMP SOCKET

[75] Inventors: James M. Drapcho; Kenneth P. Cope, both of Warren; Melodee A. Chapin, Cortland; Edward M. Bungo, Cortland; Ronald A. Baldwin, Cortland, all of Ohio; Ralph W. Crouse, Anderson, Ind.

[73] Assignee: General Motors Corporation, Detroit, Mich.

[21] Appl. No.: 735,144

[22] Filed: Jul. 24, 1991

[51] Int. Cl.[5] ..... H01R 33/46

[52] U.S. Cl. ..... 439/672; 439/559; 439/918; 439/336

[58] Field of Search ..... 439/611-619, 439/336, 337, 271, 272, 273, 556, 559, 672, 918; 313/51, 318

[56] References Cited

U.S. PATENT DOCUMENTS

| | | | |
|---|---|---|---|
| 2,982,939 | 5/1961 | Kirk | 439/672 X |
| 3,982,813 | 9/1976 | Cope et al. | 439/548 |
| 4,653,841 | 3/1987 | Plyer | 439/918 X |
| 4,804,343 | 2/1989 | Reedy | 439/336 X |
| 4,940,422 | 7/1990 | Forish et al. | 439/548 X |

*Primary Examiner*—Neil Abrams
*Assistant Examiner*—Khiem Nguyen
*Attorney, Agent, or Firm*—Edward J. Biskup

[57] ABSTRACT

A lamp socket for a lamp bulb having a contact base that includes a right angle/single piece plastic socket portion having a tubular part into which a metallic ring-like member is insertable and serves the dual purpose of a lamp bulb retainer as well as the ground contact for the lamp bulb.

10 Claims, 3 Drawing Sheets

LAMP SOCKET

This invention concerns lamp sockets and more particularly relates to a right angle plastic lamp socket in which the wire terminals are connected to the bulb contacts through a terminal housing formed generally perpendicularly to the longitudinal center line of the lamp bulb.

Vehicle tail lamp housings are frequently located interiorly of the exterior sheet metal of the vehicle, in which case, there may be no need for sealing between the connecting interfaces of the lamp socket and the lamp housing. However, in some cases, it may be desirable to locate the lamp housing exteriorly of the outer sheet metal with the effect that the aforementioned connecting interfaces are exposed to dirt, moisture and all weather conditions. In such case, the connecting interfaces of the lamp socket and the lamp housing as well as the exposed portion of the the lamp socket body should be sealed against all weather conditions to prevent the dirt and moisture from gaining access thereto and causing a deterioration thereof.

One type of lamp socket that heretofore has been used for providing a sealed lamp socket and lamp housing combination can be seen in U.S. Pat. No. 3,982,813 in the name of Cope et al, issued on Sept. 28, 1976 and assigned to the assignee of this invention. Although the Cope et al lamp socket has been successfully used for this purpose, it is not entirely satisfactory from a manufacturing standpoint because the plastic housing or body of the lamp socket is formed in two parts and requires the inner chamber thereof to be filled with grease. As a result, the Cope et al lamp socket has been found to be expensive to manufacture and, due to the number of parts involved, does not lend itself well to automated manufacture.

Accordingly, the objects of the present invention are to provide a new and improved lamp socket for a lamp bulb characterized in that the socket body portion is formed as a one piece plastic member into which the lamp bulb retainer, the ground terminal and the feed terminals can be readily assembled thereto by use of automated assembly equipment; to provide a new and improved lamp socket for a lamp bulb having a contact base that includes a right angle/single piece plastic socket body portion having a tubular part into which a metallic ring-like insert member is insertable and serves the dual purpose of a lamp bulb retainer as well as the ground contact for the bulb; to provide a new and improved socket for a lamp bulb having a double-contact type base that is sealed from all weather conditions and is provided with a pair of feed terminals each of which has a cantilevered contact member the free end of which provides a wiping engagement with another part of the feed terminal each time a lamp bulb is inserted into the retainer located in the socket body portion; and to provide a new and improved lamp bulb socket for a lamp bulb having a double contact base characterized in that the socket body has a pair of feed terminals each of which is provided with a cantilevered contact member which serves as a spring for firmly maintaining the lamp bulb within the J-type slots formed in a ring-like bulb retainer press-fitted within the plastic one-piece socket body portion of the assembly and also provides an electrical connection with one of the two contacts of the lamp bulb base.

The above and other objects and advantages are realized in accordance with the present invention by a lamp socket assembly that is intended to receive a lamp bulb having a bayonet-type base with a double-contact. In the preferred form, the lamp socket comprises a single piece plastic socket body having a tubular socket portion which accommodates a bulb retainer/ground member and is integrally formed with a connector portion which houses the ground and feed terminals. The tubular socket portion is located along a first axis while the connector portion is located along a second axis which is substantially perpendicular to the first axis. The bulb retainer/ground member is located within an opening formed in the socket portion that is surrounded by an inner wall having a column member projecting radially inwardly from the inner wall with its longitudinal center axis being located substantially parallel to the first axis. A guide slot is also formed in the inner wall at a point diametrically opposed to the column member and is located along an axis which is also substantially parallel to the first axis. The retainer/ground member is made of a metallic material and has a body portion in the form of a split ring with each of the opposed facing end surfaces being provided with a barb adapted to engage one side of the column member. A tongue depends from the body portion of the retainer/ground member and is adapted to be located in the guide slot for providing electrical contact with the ground terminal. In addition, each of the feed terminals has a cantilevered contact member located within the inner diameter dimension of the retainer/ground member whereby insertion of the lamp bulb into the retainer/ground member followed by rotation of the lamp bulb results in the double-contacts of the lamp bulb base making electrical engagement with the contact members of the feed terminals and firm retention thereby within the retainer ground member.

A more complete understanding of the present invention can be obtained from the following detailed description when taken in conjunction with the accompanying drawings in which.

Figure 1:
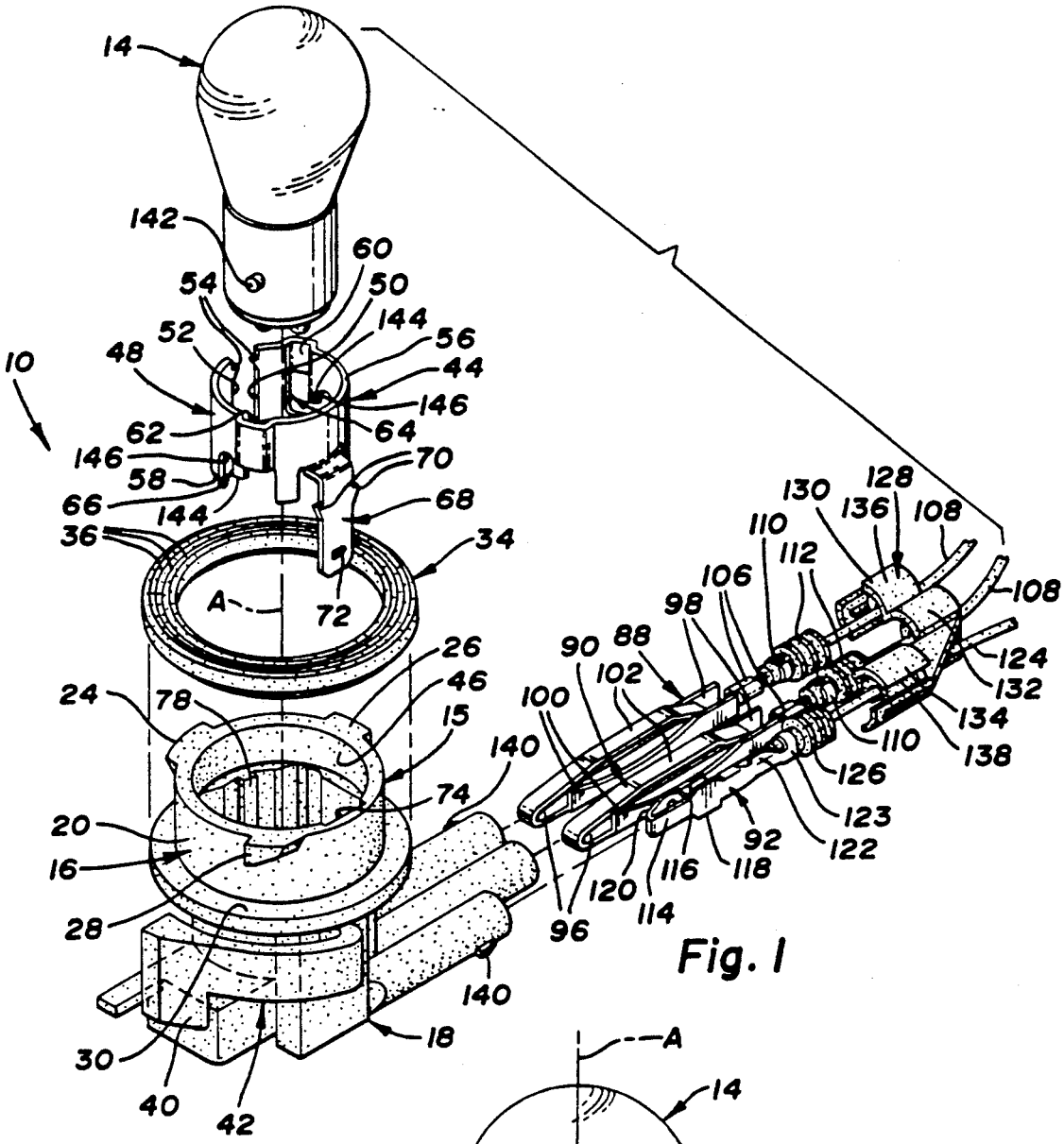
FIG. 1 is an exploded isometric view showing the various parts of the lamp socket made in accordance with the present invention.
Figure 2:
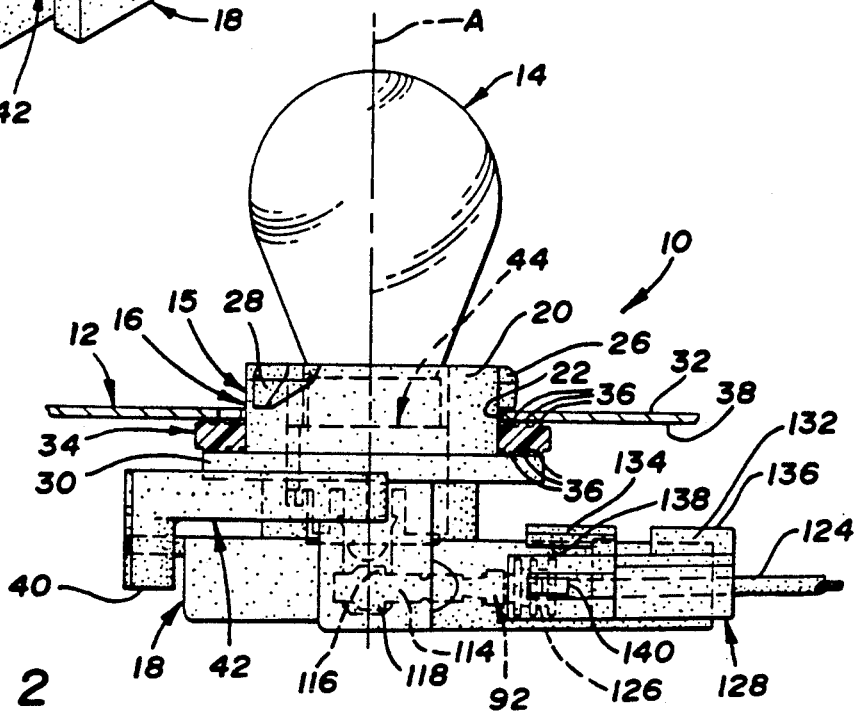
FIG. 2 is a side elevational view showing the lamp socket of FIG. 1 assembled and mounted within a panel portion of a lamp housing.
Figure 3:
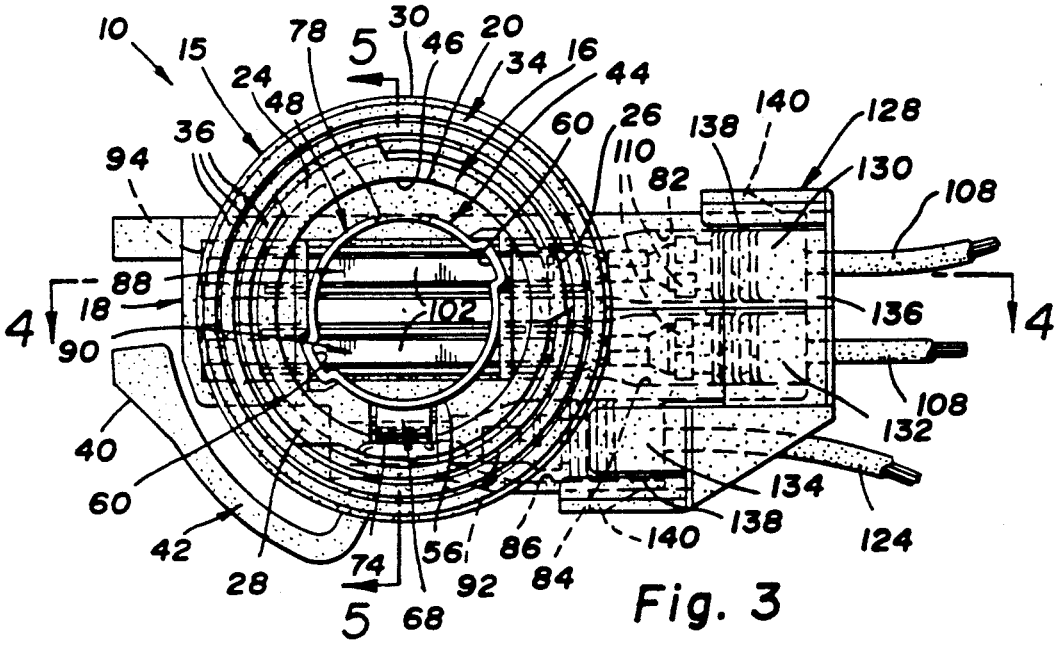
FIG. 3 is a top plan view of the lamp socket seen in FIG. 2 with the lamp bulb removed.

Referring now to the drawings and more particularly to FIGS. 1-3 thereof, a lamp socket 10 is shown mounted in a rear panel portion 12 of a lamp housing (such as employed in tail lamp assemblies or side marker lamps of a motor vehicle) for locating an electrically energizable lamp bulb 14 in a desired axial and rotational position with respect to the optical components of the lamp housing. The lamp socket 10 is suitable for such applications wherein the rear panel portion 12 is in an exposed position subject to all weather conditions thereby requiring an effective seal of the lamp socket 10 as well as the interface between the lamp socket assembly 10 and the panel portion 12.

As alluded to, the panel portion 12 forms the rear wall of a lamp housing in which the lamp bulb 14 must be accurately positioned with respect to a lens and/or the parabolic reflector for directing light from the lamp housing when the lamp bulb 14 is energized. Typically, the rear surface of the lamp housing will be located in close proximity to a vehicle body component. As a result, the lamp socket 10 according to the present invention includes a right angle socket body 15 consisting of a generally tubular portion 16 and a generally rectangular connector portion 18 integrally formed therewith. The tubular portion 16 is formed with a cylindrical outer peripheral wall 20 that is of slightly less in diameter than a central circular mounting hole 22 in the panel portion 12. Although not shown, the mounting hole 22 includes the usual clearance slots so that the tubular portion 16 of the socket body 15 will fit only one way axially through the mounting hole 22. In this regard and as seen in FIG. 1, retention ears 24, 26 and 28 are formed on the upper periphery of the wall 20 of the tubular portion 16 and extend axially toward an annular flange 30 integrally formed with the tubular portion 16. Each of the ears 24, 26 and 28 has a generally trapezoidal configuration when viewed from the front and a lead taper thereon which facilitates fit of the tubular portion 16 of the socket body into the mounting hole 22. As is conventional, the lead taper is adapted to engage the clearance slots at the perimeter of the mounting hole 22 so that the tubular portion 16 will be easily aligned for axial insertion to a point where the rear wall on each of the retention ears 24–28 will be located axially inwardly of the inner surface 32 of the panel portion 12 prior to final torque application for assembly of the lamp socket 10 to the lamp housing.

As seen, the tubular portion 16 has an annular gasket 34 supported thereon adjacent the flange 30. The gasket 34 has a thickness which is adapted to produce an interference fit between the panel portion 12 and the flange 30 when the tubular portion 16 of the socket body is located within the mounting hole 22. More specifically, the gasket 34 is in the form of a ring with each side thereof provided with a plurality of equally spaced concentric and outwardly projecting circular ribs 36. As best seen in FIG. 2 and 3, the the ribs 36 extend outwardly from the body of the gasket 34 an equal distance so that the outer tips of the ribs are located in a common plane which is perpendicular to the longitudinal center axis A of the tubular portion 16.

During the installation of the lamp socket 10 to the panel portion 12, the retention ears 24–28 are first axially aligned with the associated clearance slots after which the lamp socket 10 is moved axially into the mounting hole 22 until the ears 24–28 are located axially inwardly of the inner surface 32 of the panel portion 12. The lamp socket 10 is then rotated to a locked position during which time the ears 24–28 pull the flange 30 towards the outer wall 38 of the panel portion 12 to compress the ribs 36 of the gasket 34 into a tight sealed relationship with the mounting hole 22. The locked position of the lamp socket 10 is attained when a catch member 40 on a lock arm 42 integrally formed with the tubular portion 16 snaps radially outwardly into engagement with a lock member (not shown) located on the panel portion 12. A similar locking arrangement can be seen in U.S. Pat. No. 4,804,343 issued on Feb. 14, 1989 and assigned to the assignee of this invention.

Figure 6:
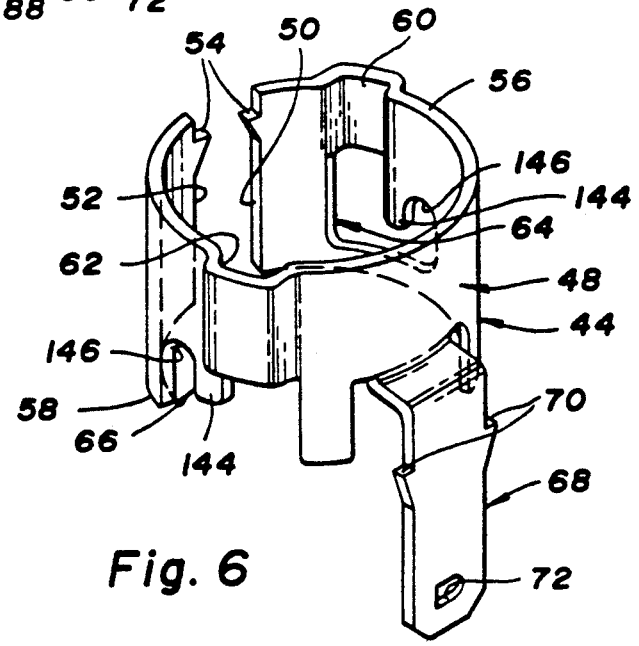
FIG. 6 is an enlarged isometric view of the retainer/-ground member which forms a part of the lamp socket.
Figure 5:
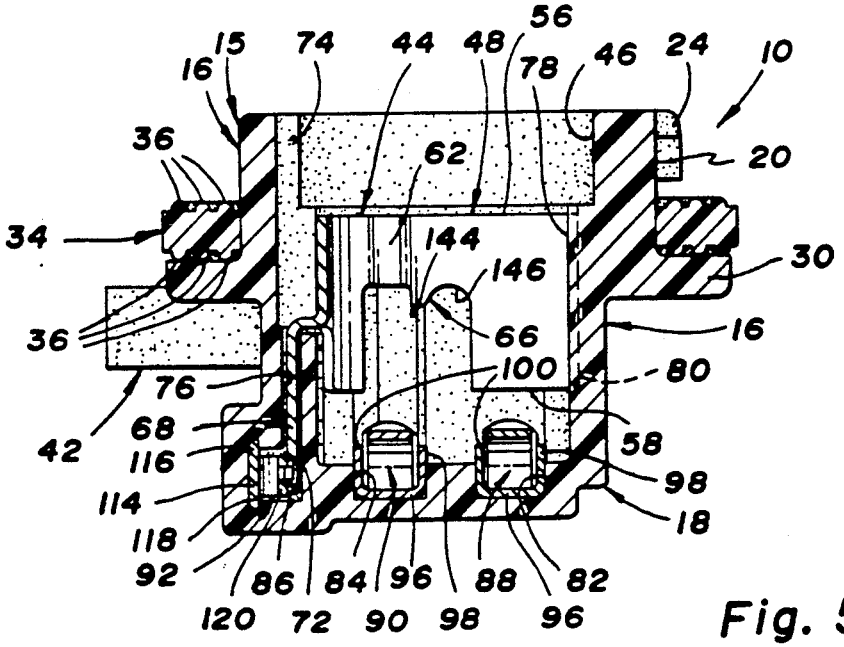
FIG. 5 is a sectional view of the lamp socket assembly taken on line 5—5 of FIG. 3.

The lamp bulb 14 is adapted to be mounted within a retainer/ground member 44 which serves as an insert member that is insertable into and fixedly supported within an opening defined by a generally cylindrical wall 46 formed in the tubular portion 16 of the socket body. As best seen in FIGS. 1, 2, and 6 the retainer/ground member 44 is made of a metallic material and has a base or body portion 48 in the form of a split ring with each of the opposed facing and parallel end surfaces 50 and 52 being provided with a barb 54. The base portion 48 has a top edge 56 and a bottom edge 58 both of which are located in parallel planes positioned normal to the longitudinal center axis of the base portion 48. In addition, the base portion 48 is formed with a pair of diametrically opposed guide channels 60 and 62 with the guide channel 60 merging with a part of a J-slot 64 in the base portion. The guide channel 62 merges with the upper portion of a part of a similar J-slot 66 located at a lower level from edge 56 than the J-slot 64. A tongue 68 depends from and is integrally formed with the base portion 48 and, as seen in FIGS. 5 and 6, is slightly offset radially outwardly from the outer peripheral surface of the base portion 48. The tongue 68 is planar in configuration and has the opposed sides thereof formed with identical barbs 70 located adjacent the upper end of the tongue 68. The lower end of the tongue is provided with an aperture 72 and it will be noted that, as seen in FIG. 5, the tongue 68 is located in a plane which is parallel to the longitudinal center axis A of the base portion 48 and the longitudinal center axes of the guide channels 60 and 62.

When the retainer/ground member 44 is to be assembled to the tubular portion 16 of the socket body 15, initially the tongue 68 is vertically aligned with a guide channel 74 formed in the inner wall 46 of the opening of the tubular portion 16. As seen in FIG. 5, the guide channel 74 is vertically aligned with a guide slot 76 located in the base of the tubular portion 16 and is positioned diametrically opposed to a column member 78 which projects radially inwardly from the inner wall 46 towards the center longitudinal axis A of the tubular portion 16. The lower end of the column member terminates with a pair of shelves 80 located on opposite sides thereof. Thus, when the retainer/ground member 44 is inserted into the opening defined by wall 46 of the tubular portion 16, the tongue 68 is guided by the guide channel 74 until it enters the guide slot 76. At the same time the opposed end surfaces 50 and 52 of the base portion 48 engage the opposed sides of the column member 78 and as the retainer/ground member 44 is moved further into the opening of the tubular portion 16, the tongue 68 continues to move into the guide slot 76 and the opposed end surfaces 50 and 52 slid along the opposed sides of the column member 78 until the lower edge 58 of the base portion 48 adjacent the opposed end surfaces 50 and 52 contacts the shelves 80 adjacent the lower end of the column member 78 and the offset connecting part of the tongue 68 contacts the entrance end of the guide slot 76. At this point, the barbs 54 formed adjacent the top edge 56 on the opposed end surfaces 50–52 of the base portion 48 will bite into the opposed sides of the column member 78 and the barbs 70 formed on the opposed sides of the tongue 68 will similarly bite into the side walls defining the guide slot 76 to lock the retainer/ground member 44 inside the opening of the tubular portion 16.

Figure 4:
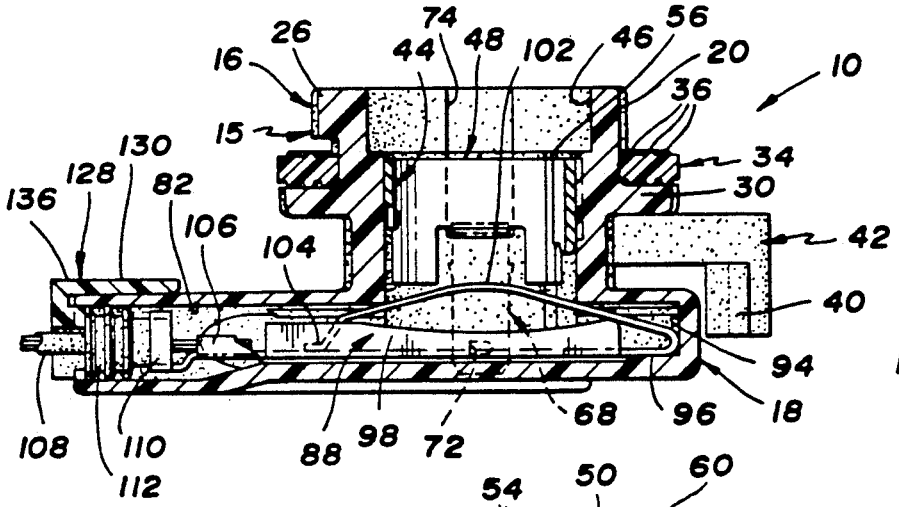
FIG. 4 is a sectional view of the lamp socket taken on line 4—4 of FIG. 3.
Figure 7:
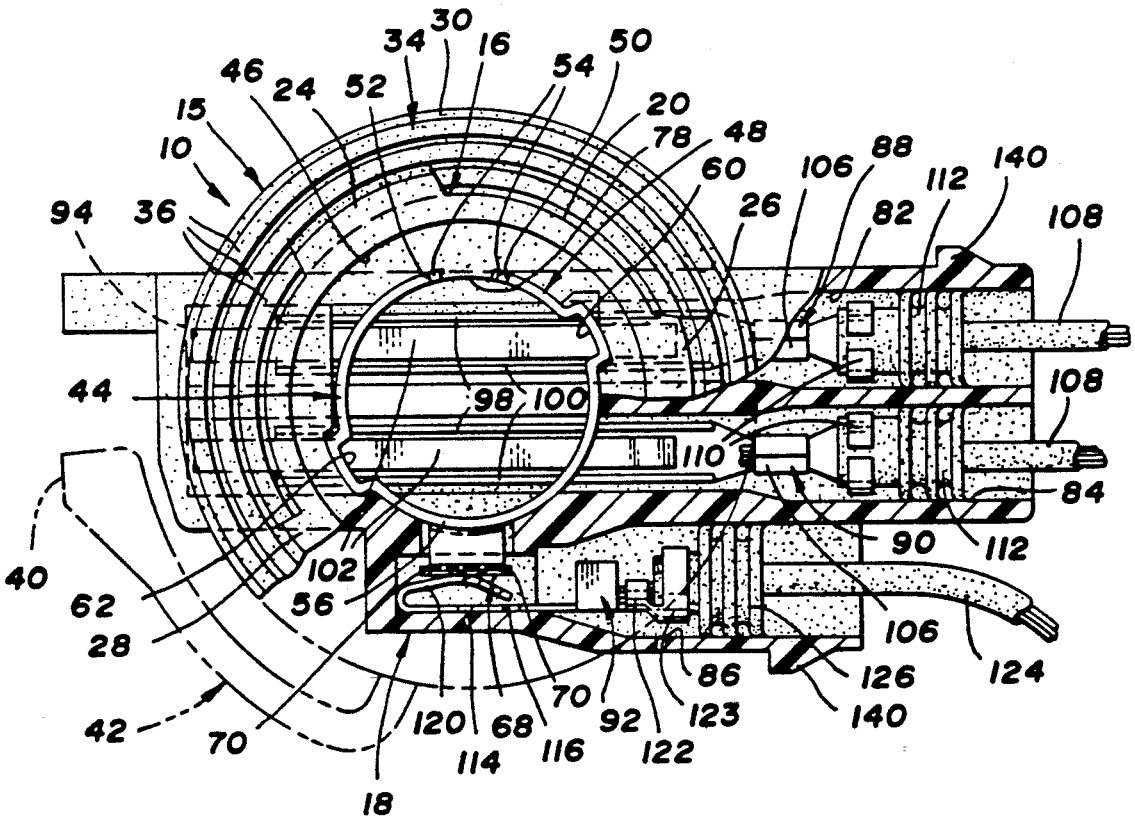
FIG. 7 is an enlarged view similar to that seen in FIG. 3 with some parts broken away and/or removed so as to shown in detail the design of the lamp pocket and the interconnection of the retainer/ground member and the ground terminal.

As seen in FIGS. 4, 5, and 7, the rectangular connector portion 18 is formed with three laterally spaced and parallel elongated cavities 82, 84 and 86 each of which having a longitudinal center axis which is substantially perpendicular to the longitudinal center axis A of the tubular portion 16. The cavities 82 and 84 serve to support a pair of identical feed terminals 88 and 90, respectively, while cavity 86 serves to house a ground terminal 92. The entrance end of each of the cavities 82–86 is circular in cross section for a short distance into the connector portion 18 after which each of the cavities 82–86 is generally square in cross section as seen in FIG. 5. The generally square portion of each feed cavity 82–86 extends beyond the tubular portion 16 as seen in FIG. 4 and terminates with an end wall 94.

More specifically, as seen best in FIGS. 4 and 7, each of the feed terminals 88 and 90 is made of beryllium copper and comprises an elongated narrow base plate 96 integrally formed with a pair of laterally spaced upstanding side walls 98 and 100. A cantilevered contact section 102 is reversely bent from the free end of the base plate 96 and terminates with a foot 104 which engages the base plate adjacent axially spaced pairs of crimping flanges 106. The crimping flanges 106 fixedly connect the bare wire strands of a feed cable 108 to the feed terminal while crimping flanges 110 fixedly connect a cable seal 112, having ring type sealing ribs, to the feed cable 108.

As seen in FIG. 4, when each feed terminals 88 and 90 is located in its respective cavity, the reverse bend portion thereof contacts the end wall 94 of the associated cavity and the sealing ribs of the cable seal 112 serve to seal the circular entrance end of the cavity. Also, the side walls of each cavity 82 and 84 engage and support the side walls 98 and 100 of the associated feed terminal so that the latter is firmly housed within the accommodating cavity. Thus, the bowed portion of the cantilevered contact section 102 of each feed terminal are located within the inner diameter of the retainer/ground member as seen in FIGS. 3, 4 and 7.

The ground terminal 92 is adapted to be received by the ground cavity 86 as seen in FIGS. 1, 5 and 7, and has a base plate 114 which is vertically orientated and provided with a pair of oppositely extending guide fingers 116 and 118 which are received within opposed guide tracks formed in the generally square portion of the ground cavity 86. The ground terminal 92 terminates with a reversely bent contact foot 120 having a generally "V" portion which engages the aperture 72 in the tongue 68 of the retainer/ground member 44. The opposite end of the ground terminal 92 is formed with axially spaced crimping flanges 122 and 123 which, as in the case of the feed terminals 88 and 90, serve to respectively connect the strand wires of a cable 124 and a cable seal 126 to the ground terminal 92.

The feed terminals 88–90 and the ground terminal 92 are retained in the connector portion 18 of the socket body by a cable lock 128. The cable lock 128 is made from a plastic material and is integrally formed with three laterally spaced semi-cylindrical projections 130, 132 and 134 which extend outwardly from a base 136 as seen in FIGS. 1 and 3. Each of the outer projections 130 and 134 is formed with a slot 138 to allow outward flexing of the side portion of the wall, each of which is formed with an elongated opening adapted to be snapped over and mate with a tapered catch 140 integral with the connector portion 18. Thus, when the cable lock 128 is joined to the end of the connector portion 18, the projections 130–134 register with and accomodate the cylindrical outer portions of the cavities 82–86 and the side portions of the wall snap into locked engagement with the catches 140 resulting in the cable lock 128 being located on the connector portion 18 to prevent removal of the feed terminals 88–90 or the ground terminal 92.

From the above description, it should be apparent that when the various parts of the lamp socket seen in FIG. 1, are assembled so as to provide the lamp socket 10 seen in FIGS. 3–5, the lamp socket 10 will be in a condition to receive the lamp bulb 14. In this regard, the lamp bulb 14 is a dual filament bulb and has a base provided with a double-contact so that the lamp bulb 14 is suitable for use in automotive lights such as front and rear running lights, signal directional turning lights, parking lights and also rear lights that produce a stop indication. Also, the base of the light bulb 14 is also provided with a pair of diametrically opposed outwardly projecting pins (one of which only is shown in FIG. 1 and indicated by the reference numberal 142). The pins are indexed so as to allow the base of the light bulb 14 to be inserted into the retainer/ground member 44 in one rotational position only. Thus, the pins of the light bulb base first enter the guide channels 60 and 62 until the dual contacts on the base engage the contact sections 102 of the feed terminals 88 and 90. This is followed by universal pressure being applied to the light bulb 14 against the spring bias of the contact sections 102 after which the light bulb 14 is rotated to cause one of the pins 142 to clear the separator part 144 of each J-slot 64–66 and permit the spring force of the contact sections 102 to raise the pin 142 on each side of the base into the groove 146 of the associated J-slot and thereby lock the lamp bulb 14 in the retainer/ground member 44. In the locked position of the light bulb 14 in the lamp socket 10, one of the contacts on the light bulb base is in electrical contact with one of the feed terminals and the other contact on the light bulb base is in electrical contact with the other feed terminal. The ground contact is provided through the pins on the light bulb base and the retainer/ground member 44 to the ground terminal.

Various changes and modifications can be made in the construction of this lamp socket without departing from the spirit of the invention. Such changes and modifications are contemplated by the inventors and they do not wish to be limited except by the scope of the appended claims.

The embodiments of the invention in which an exclusive property of privilege is claimed are defined as follows.

1. A lamp socket for a lamp bulb having a base with contact means, said lamp socket comprising a plastic socket body having a tubular portion provided with an inner wall for receiving an insert member along a first axis and having a connector portion for receiving a feed terminal and a ground terminal along laterally spaced parallel second axes each of which is substantially perpendicular to the first axis, said inner wall having a column member projecting radially inwardly therefrom with its longitudinal center axis being located substantially parallel to said first axis, a guide slot formed in said inner wall along an axis substantially parallel to said longitudinal center axis, said insert member being made of a metallic material and having a body portion in the form of a split ring with each of the opposed facing end surfaces being adapted to engage one side of the column member, and a tongue depending from said body portion and adapted to be located in said guide slot for providing electrical contact with said ground terminal, said feed terminal having a contact member located in line with the inner diameter of said insert member whereby insertion of said lamp bulb into said insert member followed by rotation of the lamp bulb results in the contact means of the lamp bulb base making electrical engagement with the contact member of the feed terminal and the base of the lamp bulb making electrical engagement with the ground terminal through the insert member.

2. A lamp socket for a lamp bulb having a base with a double-contact, said lamp socket comprising a plastic socket body having a tubular portion provided with an inner wall for receiving an insert member along a first axis and having a connector portion for receiving a pair of feed terminals and a ground terminal along laterally spaced parallel second axes each of which is substantially perpendicular to the first axis, said inner wall having a column member projecting radially inwardly therefrom with its longitudinal center axis being located substantially parallel to said first axis, a guide slot formed in said inner wall at a point diametrically opposed to said column member and along an axis substantially parallel to said longitudinal center axis, said insert member being made of a metallic material and having a body portion in the form of a split ring with each of the opposed facing end surfaces being provided with a barb adapted to engage one side of the column member, and a tongue depending from said body portion and adapted to be located in said guide slot for providing electrical contact with said ground terminal, each of said feed terminals having a cantilevered contact member located in line with the inner diameter of said insert member whereby insertion of said lamp bulb into said insert member followed by rotation of the lamp bulb results in the double-contact of the lamp bulb base making electrical engagement with the contact members of the feed terminals and the base of the lamp bulb making electrical engagement with the ground terminal through the insert member.

3. A lamp socket for a lamp bulb having a base with a double-contact, said lamp socket comprising a plastic socket body having a tubular portion provided with an inner wall for receiving an insert member along a first axis and having a connector portion for receiving a pair of feed terminals and a ground terminal along laterally spaced parallel second axes each of which is substantially perpendicular to the first axis, said inner wall having a column member projecting radially inwardly therefrom with its longitudinal center axis being located substantially parallel to said first axis, a guide slot formed in said inner wall at a point diametrically opposed to said column member and along an axis substantially parallel to said longitudinal center axis, said insert member being made of a metallic material and having a generally cylindrical body portion in the form of a split ring with each of the opposed facing end surfaces being provided with a barb adapted to engage one side of the column member and be fastened thereto, and an offset tongue depending from said body portion with a barb located on each side of said tongue, said tongue adapted to be located in said guide slot and fastened therein by said barbs on said tongue so as to provide electrical contact with said ground terminal, each of said feed terminals having a cantilevered contact member and located within the inner diameter dimension of said insert member whereby inserting of said lamp bulb into said insert member followed by rotation of the lamp bulb results in the double-contact of the lamp bulb base making electrical engagement with the contact members of the feed terminals and the base of the lamp bulb making electrical engagement with the ground terminal through the insert member.

4. The lamp socket of claim 3 wherein said barbs on said tongue are located at the upper end of said torque.

5. The lamp socket of claim 3 wherein said body portion has a top edge and a bottom edge and the barbs on said end surfaces are located adjacent said top edge.

6. The lamp socket of claim 3 wherein said body portion is formed with J-slots for accommodating said base of the lamp bulb.

7. The lamp socket of claim 1 wherein said tubular portion is provided with an annular flange and a plurality of ears axially spaced from the flange.

8. The lamp socket of claim 7 wherein a gasket is mounted on said tubular portion between said flange and said ears.

9. The lamp socket of claim 8 wherein said gasket is provided with a plurality of equally spaced concentric ribs on the opposed sides of said gasket.

10. The lamp socket of claim 9 wherein the outer tips of said ribs on each side of said gasket are located in a common plane which is perpendicular to the center axis of said gasket.

* * * * *